US006678218B2

(12) United States Patent
Serex et al.

(10) Patent No.: US 6,678,218 B2
(45) Date of Patent: Jan. 13, 2004

(54) TIMEPIECE INCLUDING A GENERATOR

(75) Inventors: Florian Serex, Prêles (CH); Frédéric Leuba, La Chaux-de-Fonds (CH); Denis Burdet, Neuchâtel (CH)

(73) Assignee: ETA Sa Fabriques d'Ebauches, Grenchen (CH)

( * ) Notice: Subject to any disclaimer, the term of this patent is extended or adjusted under 35 U.S.C. 154(b) by 0 days.

(21) Appl. No.: 10/098,355

(22) Filed: Mar. 18, 2002

(65) Prior Publication Data

US 2002/0136151 A1 Sep. 26, 2002

(30) Foreign Application Priority Data

Mar. 20, 2001 (CH) ..... 0508/01

(51) Int. Cl.[7] ..... G04F 5/00; G04C 3/00

(52) U.S. Cl. ..... 368/160; 368/163; 368/203; 368/204

(58) Field of Search ..... 368/203–204, 368/160–163

(56) References Cited

U.S. PATENT DOCUMENTS 5,581,519 A * 12/1996 Hara et al. ..... 368/64
5,668,414 A 9/1997 Takahashi et al.
5,699,322 A * 12/1997 Born ..... 368/66
5,751,666 A * 5/1998 Farine et al. ..... 368/140
6,113,259 A * 9/2000 Farine et al. ..... 368/140
6,163,126 A * 12/2000 Kojima et al. ..... 318/685
6,359,075 B1 * 3/2002 Wollum et al. ..... 525/314
6,424,600 B1 * 7/2002 Okeya et al. ..... 368/204

FOREIGN PATENT DOCUMENTS

EP 0 822 470 A1 7/1997

* cited by examiner

*Primary Examiner*—David Martin
*Assistant Examiner*—Michael L. Lindinger
(74) *Attorney, Agent, or Firm*—Sughrue Mion, PLLC

(57) ABSTRACT

The timepiece includes a time base (13), a generator (1) formed in particular of a rotor (2) with permanent magnets and at least one coil (3), a barrel (6) with a mainspring coupled to said generator in order to drive it, analogue time indicating means (7) also driven by said barrel. These time indicating means operate substantially synchronously relative to said time base as long as the torque $C_B$ provided by said barrel is greater than or equal to a minimum synchronisation torque $C_{SYNC}$. The timepiece also includes means (12, 16) for braking said generator, magnetised means (18) having with the rotor, when the generator is stopped, a static positioning torque $C_P$ allowing said rotor to be kept in a substantially stationary position. The generator braking means are activated as soon as the time indicating means are no longer operating in a substantially synchronised manner with the time base, and the magnetised means are arranged such that the static positioning torque $C_P$ is greater than or substantially equal to a reference torque $C_{REF}$ for which the torque $C_B$ exerted by the barrel on the rotor is equal to said minimum synchronisation torque $C_{SYNC}$.

15 Claims, 3 Drawing Sheets

TIMEPIECE INCLUDING A GENERATOR

BACKGROUND OF THE INVENTION

The present invention concerns a timepiece which includes a time base, a generator, formed in particular of permanent magnets rotor and at least one coil, a barrel with a mainspring coupled to said generator in order to drive it, analogue time indicating means also driven by said barrel and operating substantially synchronously relative to the time base, as long as the torque provided by the barrel is greater than or equal to a minimum synchronisation torque, means for braking the generator, and magnetised means having, with the rotor, when the generator is stopped, a static positioning torque allowing this rotor to be kept in a substantially stationary position.

A device of this type is disclosed in European Patent No. 0 822 470. This document relates to an electronic timepiece including a power source formed by a barrel with a mainspring, which is wound manually or automatically, coupled to an AC voltage generator intended to power an electronic circuit of the timepiece, a set of time indicating hands driven by a gear train which is itself driven by the barrel, braking means for adjusting the rotational speed of the generator, for braking or stopping it, and magnets for preventing the generator from rotating, once it has been stopped.

These magnets are placed in proximity to the periphery of the generator rotor. They have a very weak attraction force and exert a weak static positioning torque on the rotor, which, in order not to prevent it from starting again, must not be greater than the torque which the barrel is capable of providing when the power reserve is almost exhausted.

A device of this type has some drawbacks. Indeed, when the minimum synchronisation torque between the hands and the time base can no longer be assured, the watch nonetheless continues to operate. Thus, the mainspring continues to unwind until the power reserve of the barrel is totally exhausted.

Moreover, in the knowledge that the minimum synchronisation torque corresponds for example to winding the mainspring one and a half turns, and that seven complete turns of the winding mechanism winds the mainspring one turn, one has to thus count a minimum of ten turns of the winding mechanism before the watch works in a synchronised manner again.

BRIEF SUMMARY OF THE INVENTION

The object of the invention is thus to overcome the drawbacks of the aforementioned prior art by providing a stopping device for the timepiece which allows a barrel torque to be maintained close to the minimum synchronisation torque when the timepiece is not operating, by stopping the generator as soon as the power reserve is no longer sufficient for the timepiece to operate in a substantially synchronised manner.

The invention thus concerns a stopping device for a timepiece of the aforementioned type, characterised in that the generator braking means are activated to stop the generator as soon as the time indicating means are no longer operating in a substantially synchronised manner with the time base, and in that the magnetised means are arranged such that the static positioning torque, which they exert on the generator rotor is greater than or equal to a reference torque for which the torque exerted by the barrel on the rotor is equal to the minimum synchronisation torque.

In order to obtain a magnet having, with the rotor, a static positioning torque greater than or equal to the reference torque, account has to be taken of the dispersion of quantities such as the stray rotor fields, the rotor manufacturing and assembly tolerances or the magnetisation levels of the magnets. In order to do this, it is necessary to manufacture a positioning magnet with a magnetic flux allowing to generate a static positioning torque with the rotor, which is considerably greater than the minimum synchronisation torque. By arranging such a magnet in a predetermined fixed position in the timepiece, the number of turns of the winding mechanism to be made in order to restart the generator may be considerable.

Indeed, with reference to FIG. 3, the selection of a magnet taking account of the aforementioned uncertainties corresponds to a static positioning torque $C_T$ between the magnet and the rotor equivalent to a barrel torque for a winding of approximately 4 turns. According to the invention, the generator is stopped for a winding of the barrel of approximately 1.5 turns.

Thus, when the barrel is being wound, the generator is not started again until the winding-mechanism has been wound a minimum of 17 turns. If it is assumed that the person wearing the watch winds the winding mechanism one and a half turns with each manipulation, he then has to effect a dozen manipulations in order to restart his watch, which may lead him to believe that his watch is no longer working.

In order to overcome this drawback, a second aspect of the invention concerns a stopping device further including means for adjusting the static positioning torque between the magnet and the rotor allowing the torque to be adjusted so that it is substantially equal to the reference torque for which the torque exerted by the barrel on the rotor is equal to the minimum synchronisation torque between the hands and the time base.

A safety factor may be taken in order to take account of the deterioration of the system, in particular, wear of the barrel and problems of gear lubrication or dirt.

This adjustment allows the timepiece to be restarted quickly, after approximately 2 or 3 manipulations, while assuring that the analogue time indicating means are synchronised with the time base.

The timepiece, according to the invention, always operates synchronously, the time indicating means being able to move forward with respect to the time base continuously or by jerks. In a preferred embodiment, the minimum synchronisation torque will be taken to ensure that the time indicating means continuously work in a synchronised manner with the time base.

The invention also relates to the associated method for adjusting the static positioning torque between the magnet and the rotor.

BRIEF DESCRIPTION OF THE DRAWINGS

Other features and advantages of the present invention will appear in the following description, given by way of non-limiting example and made with reference to the annexed drawings, in which.

DETAILED DESCRIPTION OF THE INVENTION

Figure 1:
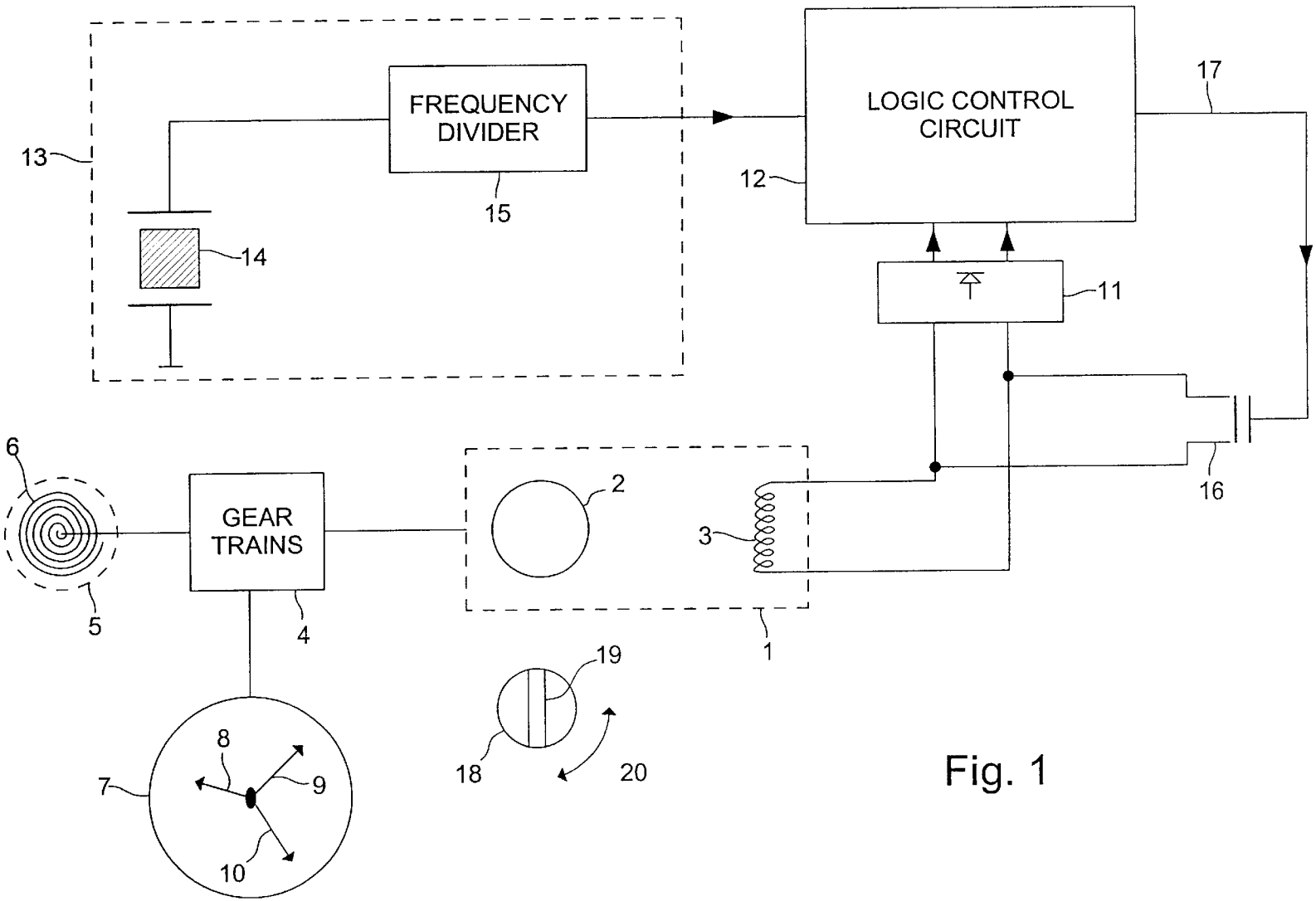
FIG. 1 shows a simplified diagram of the timepiece according to the invention.

The timepiece according to the invention, shown in FIG. 1, includes a generator symbolised by the rectangle 1 including a magnetised rotor 2 and at least a coil assembly 3. Three coils will preferably be used placed in proximity to the rotor. The rotor is mechanically coupled, for example via a gear train 4, to a barrel 5 in which is housed a mainspring 6. The latter may be wound by a manual or automatic winding mechanism, which is known and not shown in the Figure. Gear train 4 is also coupled to analogue time indicating means 7, conventionally formed of a set of hands (8, 9, 10) secured in rotation to rotor 2. Consequently, these means 7 as long as rotor 2 is moving.

Generator 1 supplies an AC voltage at a given frequency. This frequency will preferably be 5.33 turns per second. The generator is connected to a full wave rectifier 11 including smoothing capacitors to the output of which is connected a logic control circuit 12. Circuit 12 also receives time related data. It is provided with this data by a time base 13 formed in particular by a quartz oscillator 14 which supplies a pulse signal at a determined frequency, commonly 32768 Hz, to various frequency divider stages 15. The internal detail of logic control circuit 12 will not be given here. Indeed, such a circuit is known in the prior art, in particular from European Patent No. 0 822 470.

This logic control circuit 12 allows switching means 16 to be activated via a signal 17, such means being formed in particular by a MOS transistor whose source-drain path is connected between the terminals of generator 1. These switching means have the function of momentarily short-circuiting generator 1, in order to be able to adjust its rotational speed. Depending upon the short-circuit time commanded, the rotational speed will be more or less reduced.

The assembly including logic control circuit 12 and switching means 16 constitutes braking means for generator 1.

One of the objects of the invention is to obtain a timepiece, which always operates in a synchronised manner, while saving the residual energy in the barrel when the timepiece is not working. This is why, when the power reserve of barrel 5 becomes insufficient to assure synchronisation of time indicating means 7 with respect to time base 13, the braking means are used to stop generator 1 and thus hands 8, 9 and 10 connected thereto, and mainspring 6 of the barrel.

Those skilled in the art know how to determine, for a timepiece of this type, the number of turns of the mainspring necessary to assure that the hands are synchronised with respect to the time base. This necessary number of turns corresponds to a reference torque $C_{REF}$ for which the torque exerted by barrel 5 on rotor 2 is equal to the minimum synchronisation torque. In order to determine this torque corresponding to static positioning torque $C_P$ between the magnet and the rotor, this reference torque $C_{REF}$ will preferably be taken with a safety factor $f_s$ to take account of system deterioration.

When the torque exerted by barrel 5 on rotor 2, by decreasing, becomes less than minimum synchronisation torque $C_{SYN}$ of time indicating means 7 with time base 13, generator 1 rotates at a speed such that the synchronisation thereof with the reference frequency is no longer possible simply by braking.

The generator braking means are then implemented to stop it. Switching means 16 then receive a continuous signal 17 from logic control circuit 12, causing a prolonged short-circuit of the terminals of generator 1. The generator speed then becomes almost zero.

The complete stopping of generator 1 is guaranteed by at least one magnet 18 placed in proximity to the periphery of rotor 2. This magnet 18 is arranged so that the static positioning torque $C_P$ between the magnet and the rotor is greater than or substantially equal to reference torque $C_{REF}$ for which the torque exerted by barrel 5 on rotor 2 is equal to minimum synchronisation torque $C_{SYNC}$. Thus, when switching means 16 are activated in a prolonged manner, torque $C_P$ allows rotor 2 to be stopped and held substantially stationary, once the braking means are inactive.

Figure 2:
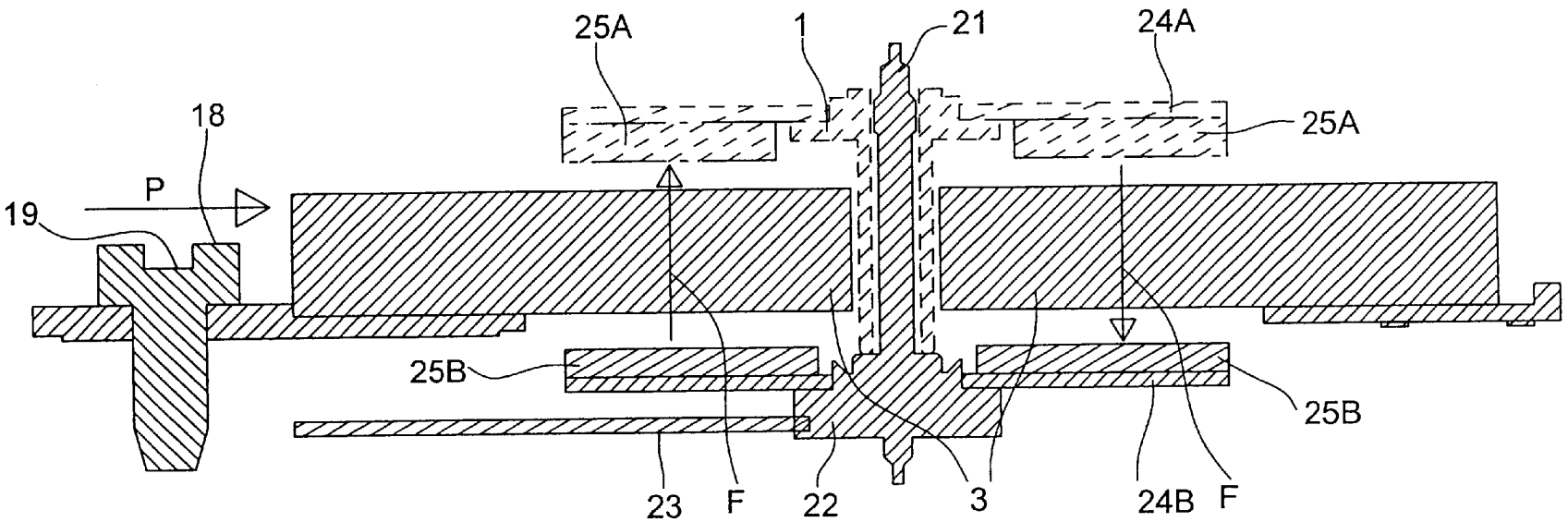
FIG. 2 shows a cross-section of the timepiece generator.

As is shown in FIG. 2, generator 1 is placed around a shaft 21 secured to a pinion meshing with an intermediate wheel 23, itself meshing with the rest of the gear train, which is not shown here. The rotor is formed of two flanges, upper flange 24A and lower flange 24B, on which are arranged an even number of magnets, respectively 25A and 25B, with alternate polarisation. These flanges are mounted on generator shaft 21. Three coils 3 are arranged between the two flanges 24A and 24B.

Preferably, six magnets will be used on each flange. Magnets 25A and 25B which face each other on upper flange 24A and lower flange 24B are positioned so as to attract each other in order to create a closed magnetic field F belonging to the generator. It is to be noted that magnets 25A and 25B used for each flange may be of different thickness.

On the periphery of generator 1, at least one positioning magnet 18 of variable direction, depending upon the orientation 19 of its polarisation, allows an associated variable direction magnetic field P to be obtained. Thus, the static positioning $C_P$ between positioning magnet 18 and flanges 24A and 24B of the rotor is variable.

Static positioning torque $C_P$ between magnet 18 and rotor 2 depends in particular upon the distance between the two and their respective magnetisation level. This is why, in order to obtain a torque $C_P$ which is greater than or substantially equal to reference torque $C_{REF}$, means for adjusting torque $C_P$ are used in a preferred embodiment.

This adjustment is effected by adjusting the position of magnet 18. In this preferred embodiment, magnet 18 is mobile in rotation which allows torque $C_P$ to be easily modified, for example when the time piece is assembled. It is also possible to provide magnetised means which slide in translation, means which allows the same results to be obtained.

Advantageously, a magnetised screw 18 will be used, driven or screwed into a hole provided for this purpose in the plate or in a bridge of the timepiece, this screw having an asymmetry such as a groove 19 indicating the direction of magnetisation and enabling a tool to turn the screw. It is interesting to note that the magnetisation indication is also used as actuating means for adjusting the orientation of the magnet.

Furthermore, reference torque $C_{REF}$ for adjusting torque $C_P$ may be taken with a safety factor $f_s$ to take account of system deterioration.

Finally, once adjusted, magnet 18 is secured in order to avoid any possibility of modifying static positioning torque $C_P$, in the event of a shock or routine repair by a professional. The securing means may be a drop of glue, a weld or any other means known to those skilled in the art.

However, it is possible to provide, in a particular embodiment, adjusting means, which are fixed in a nondefinitive way or not fixed, in order to enable a professional to adjust torque $C_P$ again in the event of a malfunction.

In an advantageous embodiment of the invention, two or more positioning magnets are arranged regularly on the periphery of the magnetised rotor in order to eliminate stray friction induced by each positioning magnet.

The invention also concerns the method for adjusting static positioning torque $C_P$ between magnet 18 and rotor 2. This method concerns a timepiece including the elements shown in FIGS. 1 and 2.

The object to be achieved, via this method, is to obtain a static positioning torque $C_P$ that is greater than or substantially equal to reference torque $C_{REF}$ for which the torque exerted by barrel 5 on rotor 2 is equal to minimum synchronisation torque $C_{SYNC}$. It is advantageous to adjust this torque $C_P$ in order that only a minimum of turns have to be effected before the timepiece works in a synchronised manner again. Preferably torque $C_P$ will be adjusted with a safety factor $f_s$ taking account of system deterioration.

First, magnet 18 is magnetised, for example in the direction of magnetisation mark 19. Then, magnet 18 has to be placed in proximity to rotor 2. The magnetic energy of the magnet and its distance from the rotor define the static positioning torque $C_P$ between the two. This torque $C_P$ varies in particular depending upon the orientation of magnet 18 with respect to rotor 2. This is why, a magnetised screw, which is mobile in rotation, is preferably used.

Secondly, this magnet 18 is selected and positioned so that the initial torque $C_P$ is greater than reference torque $C_{REF}$. The selection is achieved including all unfavourable tolerances, in particular, the stray rotor fields and the magnetisation levels of the magnets. During assembly, magnet 18 is rotated into the position in which positioning torque $C_P$ is maximum.

This torque $C_P$ is maximum when the direction of magnetisation is radial to the axis of rotor 2. Advantageously mark 19 is placed in the direction of magnetisation. But, it should be noted that this mark 19 may be placed in any other direction provided that it enables the direction of magnetisation of the magnet to be determined.

Thirdly, mainspring 6 of the barrel is pre-wound by an automaton, which is not shown, or manually, by a number of turns greater than or substantially equal to the number of turns corresponding to $C_{REF}$. Advantageously, a torque taking account of system deterioration will be selected. For example, for a torque $C_{REF}$, for which the torque exerted by the barrel on the rotor is equal to the minimum synchronisation torque, corresponding to approximately one and a half turns of the mainspring, a torque corresponding to approximately 2 turns of the mainspring will be selected. Barrel 5 may be pre-wound by the ratchet-wheel screw or by the winding stem for example.

Fourthly, once mainspring of the barrel has been pre-wound, magnet 18 is moved, by an automaton or manually, until generator 1 starts. This movement is either in rotation, in the case of a magnetised screw, or in translation, in the case of a sliding magnet. Advantageously, the use of a magnetised screw enables the magnet to be rotated using a simple screwdriver. In such case, with the rotation of the screw, static positioning torque $C_P$ between magnet 18 and rotor 2 will decrease and become less than that exerted by the barrel on the rotor. Thus, generator 1 is set in movement. This movement is detected by measuring the voltage at the generator output.

Finally, preferably, in order to prevent any disruption to the adjustment, in particular in the event of a shock, the position of magnet 18 is fixed. Such fixing may be obtained by any means known to those skilled in the art, in particular by gluing or welding.

Figure 3:
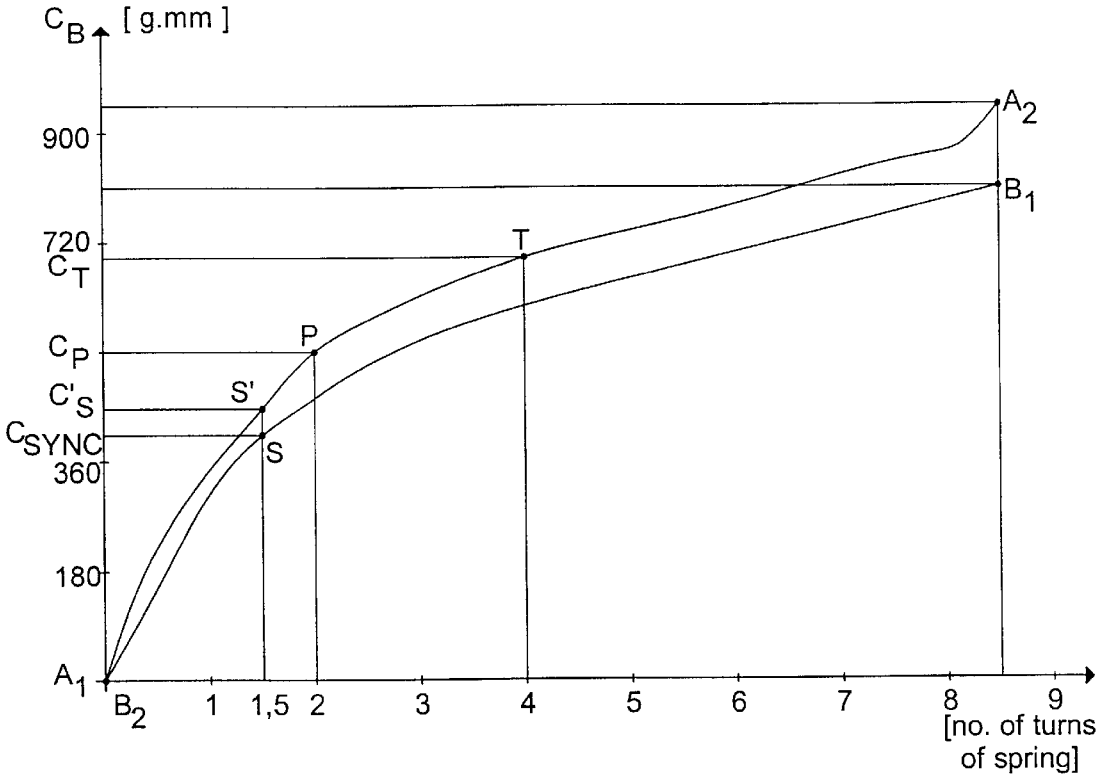
FIG. 3 shows, according to a preferred embodiment, a winding/letting down diagram of a barrel with a mainspring illustrating the evolution of the torque $C_B$ exerted by the mainspring on the rotor as a function of the number of turns of the mainspring.

FIG. 3 illustrates, according to a preferred embodiment, an example of the evolution of the torque exerted by the mainspring on the rotor as a function of the number of turns of the mainspring. The diagram is drawn in grams per millimeter as a function of the number of turns effected by the barrel, both during winding and during letting down of the mainspring. Typically, one turn of the barrel corresponds to a period of operation of approximately eight hours of the timepiece. Of course, all these values and those which will be given hereinafter are given only by way of example.

Curve A corresponds to the winding, it starts from a point A1 where the mainspring is totally let down and ends after the latter has been wound, during which the barrel makes between 8 and 9 turns, to a point A2 of maximum winding for which the potential barrel torque is approximately 950 gr.mm.

Curve B represents the letting down of the mainspring during which the barrel supplies power to the system. This curve begins at point B1 corresponding to a torque value of approximately 800 gr.mm (this reduction in torque with respect of the value of point A2 is due to inevitable system mechanical losses) and ends at a point B2 of total let down of the mainspring, this point evidently coinciding with point A1.

It will be noted that, if the timepiece is automatically wound, the curves will be followed as a function of the movements experienced by the timepiece, the two winding and letting down operations then being strictly alternated in accordance with circumstances.

The diagram also indicates, via a point S on curve B, the minimum synchronisation value of torque $C_{SYNC}$. As long as the barrel is capable of providing a torque greater than this minimum value, the generator rotor will still be able to reach the nominal rotational speed for the timepiece to keep precise time.

A point S' on curve A corresponds to point S. The difference between torque $C_{S'}$ and torque $C_{SYNC}$ corresponds to the torque that the person wearing the watch has to exert on the winding mechanism in order to be able to wind it.

The diagram also indicates, via a point P, the value of static positioning torque $C_P$ between the magnet and the rotor. This value takes account of a safety factor $f_s$ due to system deterioration.

Finally, the diagram also indicates, via a point T, the value of static positioning torque $C_P$ necessary between the magnet and the rotor when the method for adjusting torque $C_P$ according to the present invention is not implemented, in order to ensure that the generator stops when it is no longer working synchronously.

In the example shown, in FIG. 3, starting from the position, noted B1 corresponding to the complete winding of mainspring 6, the timepiece operates normally, the braking means are then only required to limit the rotational speed of generator 1.

This operating mode lasts for more than 6 turns of barrel 5 (a little more than forty hours) assuming of course that mainspring 6 is not wound manually or automatically. Gradually as this period of time passes, the recurrence of successive braking exerted by the braking means becomes lower and lower.

As long as the generator is rotating, static positioning torque $C_p$ is negligible with respect to the inertial torque of generator 1. This is why the timepiece continues to operate normally until point S.

When point S is reached, the number of winding turns of barrel 6 becomes insufficient to assure minimum synchronisation torque $C_{SYNC}$ between time indicating means 7 and time base 13. The braking means are then activated, logic control circuit 12 sending a continuous control signal 17 in order to activate switching means 16 in a prolonged manner. Generator 1 is then stopped then held stationary by static positioning torque $C_P$ between magnet 18 and rotor 2. The braking means are then deactivated. Since torque $C_P$ is greater than torque $C_{SYNC}$, the rotor is effectively held stationary.

The hands (8, 9 and 10) are also stopped, which lets the user know that he needs to wind his watch mainspring. The torque exerted by the user on the winding mechanism must be sufficient to allow passage from point S on letting down curve B to point S' on winding curve A. After approximately 2 or 3 manipulations, the torque $C_B$ exerted by the barrel on the rotor is then greater than torque $C_P$, which allows the generator and thus time indicating means 7 to start working synchronously again, which is entirely similar to a mechanical watch.

It is to be noted that, preferably, torque $C_P$ is selected so that the user is obliged to make 2 or 3 manipulations to allow the watch to start again. Thus, in the event that the user stopped winding his watch as soon as it starts to work again, this state would still last for several hours. This does not prevent the user from completely winding his watch to allow it to work longer, in particular by wearing it in the case of a automatic winding.

What is claimed is:

1. Timepiece including a time base, a generator formed in particular of a rotor with permanent magnets and at least one coil, a barrel with a mainspring coupled to said generator in order to drive it, analogue time indicating means also driven by said barrel and operating substantially synchronously relative to said time base as long as a torque $C_B$ provided by said barrel is greater than or equal to a minimum synchronisation torque $C_{SYNC}$, means for braking said generator, magnetised means having with said rotor, when the generator is stopped, a static positioning torque $C_P$ allowing said rotor to be kept in a substantially stationary position, wherein the generator braking means are activated as soon as the time indicating means are no longer operating in a substantially synchronised manner with the time base, and wherein the magnetised means are arranged such that the static positioning torque $C_P$ is greater than or substantially equal to a reference torque $C_{REF}$ for which the torque $C_B$ exerted by the barrel on the rotor is equal to said minimum synchronisation torque $C_{SYNC}$.

2. Timepiece according to claim 1, wherein it further includes means for adjusting the static positioning torque $C_{SYNC}$ between the magnetised means and the rotor allowing this torque $C_P$ to be adjusted so that it is greater than or substantially equal to said reference torque $C_{REF}$.

3. Timepiece according to claim 2, wherein said reference torque $C_{REF}$ is selected with a safety factor $f_s$ taking account of system deterioration.

4. Timepiece according to claim 2, wherein said torque $C_P$ is adjusted so that it is greater than the sum between said reference torque $C_{REF}$ and that exerted by a user to wind said timepiece.

5. Timepiece according to claim 4, wherein said magnetised means are mobile in rotation.

6. Timepiece according to claim 4, wherein said magnetised means are mobile in translation.

7. Timepiece according to claim 5, wherein said magnetised means are fixed after said positioning torque $C_P$ has been adjusted.

8. Timepiece according to claim 7, wherein said magnetised means have means for marking the direction of magnetisation.

9. Timepiece according to claim 8, wherein said means for marking the direction of magnetisation is a screw groove.

10. Method for adjusting the starting of a timepiece including a time base, a generator formed in particular of a rotor with permanent magnets and at least one coil, a barrel with a mainspring coupled to said generator in order to drive it, analogue time indicating means also driven by said barrel and operating substantially synchronously relative to said time base as long as a torque $C_B$ provided by said barrel is greater than or equal to a minimum synchronisation torque $C_{SYNC}$, means for braking said generator, magnetised means having with said rotor, when the generator is stopped, a static positioning torque $C_P$ allowing said rotor to be kept in a substantially stationary position, wherein said static positioning torque $C_P$ is adjusted when the timepiece is assembled in accordance with the following steps:

installing the magnetised means in proximity to the rotor;

positioning the magnetised means so that the static positioning torque $C_P$ with the rotor is greater than a reference torque $C_{REF}$ for which the torque $C_B$ exerted by the barrel on the rotor is equal to said minimum synchronisation torque $C_{SYNC}$;

pre-winding the barrel so that its torque $C_B$ is greater than or substantially equal to said reference torque $C_{REF}$;

moving the magnetised means in rotation and/or in translation until the generator starts.

11. Adjustment method according to claim 10, wherein said magnetised means are selected while including all unfavourable tolerances.

12. Adjustment method according to claim 10, wherein the positioning step of said magnetised means is effected so that the static positioning torque $C_P$ with the rotor is maximum.

13. Adjustment method according to claim 10, wherein said reference torque $C_{REF}$ is taken with a safety factor $f_s$ taking account of system deterioration.

14. Adjustment method according to claim 10, wherein said torque $C_P$ is adjusted to be greater than the sum between said reference torque $C_{REF}$ and that exerted by a user in order to wind the timepiece.

15. Adjustment method according to claim 10, wherein it includes an additional step of fixing the magnetised means once the static positioning torque $C_P$ has been adjusted.

* * * * *